US009121141B2

(12) United States Patent
Thieme et al.

(10) Patent No.: US 9,121,141 B2
(45) Date of Patent: Sep. 1, 2015

(54) SLIPFORM PAVER, AS WELL AS METHOD FOR ADJUSTING THE WIDTH OF A MOLD DEVICE

(71) Applicant: Wirtgen GmbH, Windhagen (DE)

(72) Inventors: Holger Thieme, Königswinter (DE); Cyrus Barimani, Königswinter (DE); Günter Hähn, Königswinter (DE)

(73) Assignee: Wirtgen GmbH (DE)

( * ) Notice: Subject to any disclaimer, the term of this patent is extended or adjusted under 35 U.S.C. 154(b) by 44 days.

(21) Appl. No.: 14/088,820

(22) Filed: Nov. 25, 2013

(65) Prior Publication Data

US 2015/0056015 A1 Feb. 26, 2015

(30) Foreign Application Priority Data

Aug. 26, 2013 (DE) ..... 10 2013 216 950

(51) Int. Cl.
*E01C 19/42* (2006.01)
*E01C 19/00* (2006.01)
*E01C 19/40* (2006.01)

(52) U.S. Cl.
CPC ..... *E01C 19/002* (2013.01); *E01C 19/40* (2013.01); *E01C 19/42* (2013.01); *E01C 2301/14* (2013.01); *E01C 2301/16* (2013.01); *E01C 2301/18* (2013.01)

(58) Field of Classification Search
CPC ..... E01C 19/002; E01C 19/40; E01C 19/42; E01C 2301/14; E01C 2301/16; E01C 2301/18
USPC ..... 404/72, 75, 84.05, 84.1, 118, 105
See application file for complete search history.

(56) References Cited

U.S. PATENT DOCUMENTS

| | | | | |
|---|---|---|---|---|
| 1,782,707 | A * | 11/1930 | Bayley | 404/96 |
| 3,970,405 | A | 7/1976 | Swisher, Jr. et al. | |
| 4,197,032 | A | 4/1980 | Miller | |
| 4,379,653 | A | 4/1983 | Brown | |
| 4,586,889 | A | 5/1986 | Krohne et al. | |
| 4,678,365 | A | 7/1987 | Ban et al. | |
| 4,778,305 | A | 10/1988 | Ritchey et al. | |

(Continued)

FOREIGN PATENT DOCUMENTS

| | | | |
|---|---|---|---|
| DE | 19814052 | A1 | 10/1999 |
| EP | 1213389 | A1 | 6/2002 |

(Continued)

*Primary Examiner* — Raymond W Addie
(74) *Attorney, Agent, or Firm* — Lucian Wayne Beavers; Patterson Intellectual Property Law, PC

(57) ABSTRACT

In a slipform paver with a tractor including a machine frame with longitudinal members and telescopable cross members, the machine frame comprises a central frame module in which the cross members are supported in a telescopable fashion. A mold adjustable to the working width comprises at least one permanent central mold element fixed relative to the central frame module and at least one permanent outer mold element movable relative to the central frame module. The permanent outer mold element is permanently attached to one of the cross members and/or one of the longitudinal members and the outer mold element is movable together with the cross member and/or the longitudinal member during the adjustment of the working width of the machine frame.

24 Claims, 7 Drawing Sheets

(56) References Cited

U.S. PATENT DOCUMENTS

| | | | | |
|---|---|---|---|---|
| 4,789,266 | A | 12/1988 | Clarke, Jr. et al. | |
| 4,900,186 | A | 2/1990 | Swisher, Jr. et al. | |
| 5,590,977 | A | 1/1997 | Guntert et al. | |
| 5,615,972 | A | 4/1997 | Guntert et al. | |
| 5,647,688 | A | 7/1997 | Guntert et al. | |
| 5,941,658 | A * | 8/1999 | Dahlinger et al. | 404/84.1 |
| 6,022,170 | A | 2/2000 | Röwer | |
| 6,390,728 | B1 | 5/2002 | Casters | |
| 6,471,442 | B1 | 10/2002 | Deeb et al. | |
| 6,497,531 | B2 | 12/2002 | Sipherd et al. | |
| 6,582,152 | B2 | 6/2003 | Leone et al. | |
| 6,872,028 | B2 | 3/2005 | Aeschlimann et al. | |
| 6,890,123 | B2 * | 5/2005 | Piccoli | 404/72 |
| 7,651,295 | B2 | 1/2010 | Eppes et al. | |
| 7,950,874 | B2 | 5/2011 | Guntert, Jr. et al. | |
| 8,267,619 | B2 * | 9/2012 | Munz | 404/118 |

FOREIGN PATENT DOCUMENTS

| | | | |
|---|---|---|---|
| WO | 9528525 | A1 | 10/1995 |
| WO | 9704176 | A1 | 2/1997 |
| WO | 9950503 | A1 | 10/1999 |
| WO | 02101150 | A1 | 12/2002 |
| WO | 2010120722 | A1 | 10/2010 |

* cited by examiner

SLIPFORM PAVER, AS WELL AS METHOD FOR ADJUSTING THE WIDTH OF A MOLD DEVICE

BACKGROUND OF THE INVENTION

1. Field of the Invention

The invention relates to a slipform paver, as well as to a method for adjusting the width of a mold device of a slipform paver.

2. Description of the Prior Art

Such slipform pavers serve the purpose of producing road pavements made of concrete. Known slipform pavers comprise a tractor, which may also be termed basic machine or carrier machine and consists of a machine frame and four ground-engaging units, where the tractor carries different working devices for the production of a concrete roadway, where a concrete mold extending transverse to the roadway is used to form the concrete.

As the desirable width of a concrete roadway may vary in the event of acceleration lanes or in the event of a general change in the number of traffic lanes, conversion of the slipform pavers is frequently required which may take up several hours of conversion time depending on the necessary extent of the conversion work.

Such interruptions in operation are undesirable so that slipform pavers have already been developed the machine frame of which can be adjusted telescopically (WO 2002/101150, WO 99/50503).

According to WO 2002/101150, not only the machine frame is adjustable telescopically but also all of the working devices. A disadvantage created by this prior art is the reduced stiffness in particular with a telescopically extendable concrete mold.

It is already known from WO 2010/120722 to adjust a concrete mold to the adjusted working width by way of an end portion of the mold body being moved away from a central mold element hydraulically by means of a piston-cylinder unit integrated into the mold body, and multi-part intermediate elements being then mounted in the resulting gap each of which is assembled from several segments to form one intermediate element. It is necessary in this arrangement to support the end portion and the intermediate elements to be inserted on a joint plank resting on the ground, with the concrete mold being rested on said plank. Once the desired number of intermediate elements has been inserted and mounted, the end portion of the mold body is moved inward again hydraulically in order to firmly press together all the mold segments. It is of disadvantage in this design that one each additional hydraulic device is required on both sides of the machine and that the mounting effort still takes up a great deal of time as a result of the individual intermediate elements being assembled from several segments.

Furthermore, dividing an intermediate element into several segments has a negative impact on the stiffness of the mold element and thus also on the modulus of resistance of the entire mold device in the working direction as well as in the direction of gravity.

SUMMARY OF THE INVENTION

Starting from such prior art, it is the object of the invention to further develop a slipform paver of the type first mentioned above and a method for adjusting the width of the concrete mold of a slipform paver to a change in the working width in such a way that the equipment-related effort and the conversion times are reduced and that the modulus of resistance of the concrete mold of the slipform paver is increased.

The invention advantageously provides for the permanent outer mold element to be permanently attached to one of the cross members and/or one of the longitudinal members and for the outer mold element to be movable with the working width adjustment of the machine frame. As the outer mold element, being the end piece of a concrete mold, is permanently connected to the telescopable cross member and/or the longitudinal member, it can be pulled outward during the adjustment of the working width together with the cross member and/or the longitudinal member without any additional hydraulic devices for this purpose being required on the concrete mold. Following the insertion of exchangeable intermediate elements between the fixed mold element and the outer mold element, all the mold elements can be pressed together via the working width adjustment until resting against one another.

Adjustment of the working width can be effected by means of ground-engaging units aligned essentially parallel to the mold device or orthogonal to the working direction respectively, where a moving apart of the machine frame may also be effected by means of a steering action of the ground-engaging units widening the track width with or without hydraulic support by telescopic cylinders of the machine frame without the ground-engaging units having to be aligned orthogonal to the working direction.

It is preferably provided for the mold device to comprise no less than one permanent central mold element arranged preferably centrally relative to the basic frame, and no less than two permanent outer mold elements movable relative to the basic frame.

As the insertable exchangeable mold elements of different widths can be suspended completely and integrally on a supporting device arranged above the mold elements, with said supporting device interconnecting all the mold elements arranged next to one another, no additional mounting work is required for assembling the mold elements. In particular, no flat supporting elements resting on the ground below the concrete mold are required as the integrally formed mold elements are merely suspended.

Together with the concrete mold, the supporting device forms an unsupported and self-supporting structure.

When adjusted to the minimum working width, all permanent mold elements rest next to one another, and when adjusted to a wider working width, exchangeable mold elements can be suspended at the supporting device between the permanent mold elements.

It is preferably provided for the supporting device to comprise supporting beams which are guided above the no less than one central mold element in a longitudinally movable fashion and are permanently coupled with the outer mold elements. The supporting beams are preferably arranged in dual arrangement parallel to one another and may themselves be rigidly attached to the outer mold elements in an exchangeable fashion.

A further development of the invention intends for the mold device and the supporting device to be bisected in such a manner that the central mold element, to form an adjustable camber in the center of the working width, comprises two mold elements coupled to one another in an articulated fashion, each of said mold elements being coupled to one each outer mold element respectively by means of a supporting device. In this way, the two halves of the mold device can be arranged in the shape of a roof to adjust a camber for the concrete layer to be produced so that the concrete layer is elevated in the center of the roadway as opposed to the roadway shoulders.

It may also be provided in this arrangement for the central mold element to be attachable to the basic frame and/or the outer mold elements to be attachable to the cross member and/or the longitudinal member in a height-adjustable fashion.

It is preferably provided for the supporting beams of the divided mold device to extend above the same as well as parallel to and offset from one another in the working direction. The supporting beams of the divided mold device can thus not collide on the halves of the mold device in the area of the central mold element when the minimum working width is adjusted.

The ground-engaging units may be pivotable about no less than 90° at the ends of the longitudinal members. This allows for the ground-engaging units to be oriented in the working direction for the working mode on the one hand, and to be aligned transverse to the working direction for the transport mode, for example, for the transport on trailers of a truck. When aligned in their position transverse to the working direction, they are also suited to accomplish adjustment of the working width of the telescopable frame and, in the process, to additionally pull outward or move inward the outer mold elements in accordance with the desired working width.

The ground-engaging units are preferably arranged at the lower end of lifting columns which may be coupled to the longitudinal members by means of pivoting arms.

The ground-engaging units may be transferred into a desirable position either via the pivoting arms or via a steering action about no less than 90° or by means of both options.

In a preferred embodiment, it is intended for the supporting beams of the supporting device to be permanently fixed in place on the upper side of the permanent outer mold elements and to be accommodated in the no less than one central permanent mold element in one each sliding guide arranged on the upper side. Arrangement on the upper side offers the advantage of saving space in the working direction of the slipform paver. This is important as the basic frame and mold device below the basic frame must not exceed a certain width in working direction if the slipform paver is transported on a truck.

After having been suspended, the exchangeable mold elements are mounted on the supporting device in a movable fashion so long as they are not locked with neighbouring mold elements.

It is understood that any combination of exchangeable mold elements of different widths is insertable between the permanent mold elements to increase the working width. In this arrangement, the individual mold elements may exhibit a width of, for example, between 10 cm and 200 cm.

The exchangeable mold elements are integrally formed and are suspended on the supporting device as a single-part element so that no mounting work is incurred on the mold elements apart from the mutual interlocking of neighbouring mold elements themselves.

In this arrangement, the single-part design of the mold element is of particular advantage as the mold element forms a closed cross-sectional profile so that a high modulus of resistance is formed against forces acting on the mold element against the working direction and in the direction of gravity. The modulus of resistance to torsion is also and specifically increased significantly. The mold device assembled from such mold elements exhibiting a closed cross-sectional profile therefore exhibits a multiple of stiffness compared to mold elements assembled from several segments.

In accordance with the method according to the present invention to adjust the width of a mold device of a slipform paver to a pre-selected working width, the following is provided:

coupling no less than one permanent outer mold element to a cross member telescopable in width direction and/or to a longitudinal member connected to the cross member, moving the no less than one outer mold element with the working width adjustment of the machine frame, and inserting and/or removing exchangeable mold elements at a supporting device extending above the mold elements.

For example, an exchangeable mold element having a first width may be exchanged for an exchangeable mold element having a different, second width.

In this process, insertion or removal can be effected without supporting the mold elements against the ground. Using integrally formed mold elements dispenses with mounting work for assembling the exchangeable mold elements while at the same time increasing the modulus of resistance of the concrete mold.

In the following, one embodiment of the invention is explained in greater detail with reference to the drawings.

BRIEF DESCRIPTION OF THE DRAWINGS

The following is shown.

DETAILED DESCRIPTION

Figure 1:
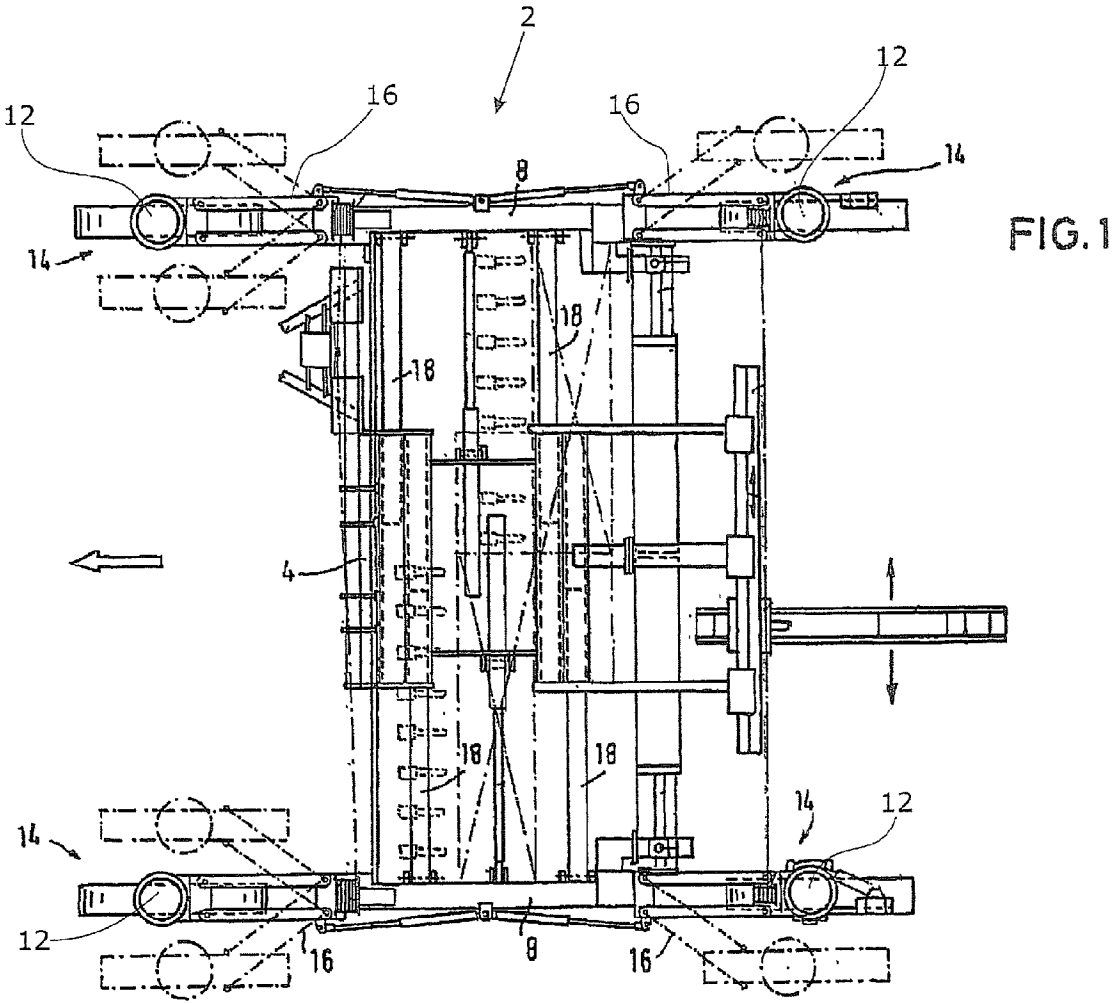
FIG. 1 a slipform paver in accordance with prior art.

FIG. 1 shows a slipform paver as it is known from WO 2002/101150, the details of which are incorporated herein by reference.

The slipform paver comprises a tractor 2 including a machine frame 4 with longitudinal members 8 extending parallel to the working direction and telescopable cross members 18 extending transverse to the working direction for variable adjustment of the working width. The cross members 18 are supported in (FIG. 2) or at a basic frame 20, where a total of four cross members 18 project, at variable length, from a basic frame 20 arranged in the center of the working width and are connected to the longitudinal members 8. The basic frame 20 may also be referred to as a central frame module.

The cross members 18 are arranged offset from one another at or in the basic frame 20 allowing for example, the working width to be varied between 3 m and 8 m. The cross members 18 may also be capable of multiple telescoping if it is intended for larger working widths to be adjustable.

One each ground-engaging unit 14 is articulated, for example, guided in a parallelogram-like fashion, at the front and rear ends of the longitudinal members 8. This enables the track width to be adjusted without changing the working width, with two each parallelogram guides or one pivoting arm 16 with a piston-cylinder unit being intended that connect the ground-engaging units 14 to the longitudinal member 8 in a pivotable fashion.

In addition, the ground-engaging units 14 at the ends of the longitudinal members 8 can be pivoted about a minimum angle of 90° so that the slipform paver can be loaded on a flatbed truck transverse to its working direction without exceeding the maximum permissible transport width.

Furthermore, lifting columns 12 arranged between the ground-engaging units 14 and the machine frame 4 allow height adjustment of the machine frame 4 in a known fashion.

Reference is made to the specification of WO 2002/101150 in regard to the further details of the working devices shown in FIG. 1.

Figure 2:
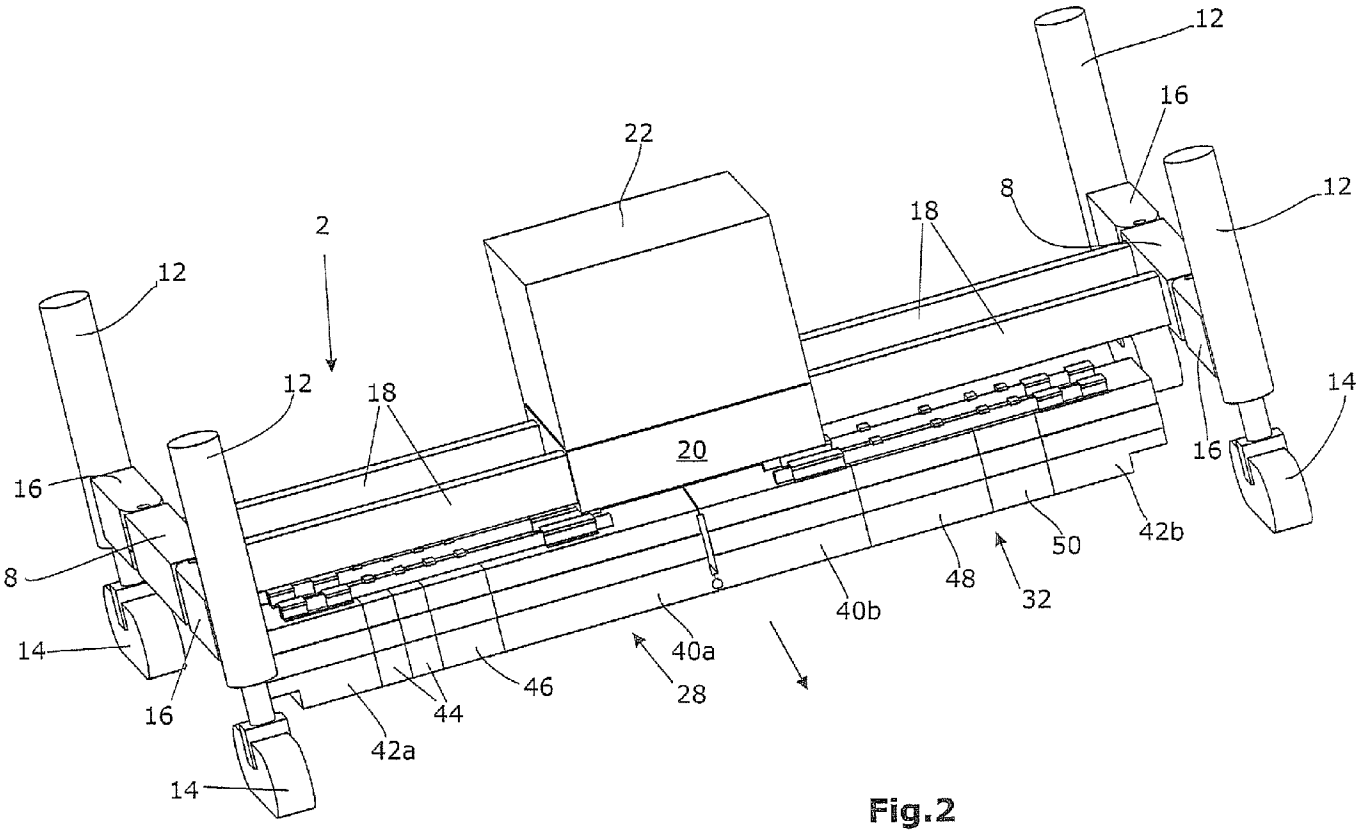
FIG. 2 a perspective schematic view of the slipform paver with the mold device according to the present invention, FIG. 3 a side view of the slipform paver according to the present invention, FIG. 4 a perspective view of the mold device, FIG. 5*a* a cross-section along line Va-Va of the supporting devices of the mold device in FIG. 4, FIG. 5*b* a cross-section along line Vb-Vb of the supporting devices of the mold device in FIG. 4, FIG. 5*c* a cross-section along line Vc-Vc of the supporting devices of the mold device in FIG. 4, FIG. 6 the mold device in spread-apart condition, and FIG. 7 the mold device in closed condition.

FIG. 2 shows a schematic, perspective view of the slipform paver according to the invention where the basic frame 20 carries a platform or cabin for the operator and driving devices which, in FIG. 2, are summarized under the reference symbol 22. The arrangement of the telescopable cross members 18 inside the basic frame can, in principle, be inferred from FIG. 1. As can be inferred from FIG. 2, a bisected mold device 28, 32 (concrete mold) is arranged underneath the basic frame 20, said mold device 28, 32 extending over the entire working width and comprising permanent mold elements 40*a*, 40*b*, 42*a* and 42*b* as well as exchangeable mold elements 44, 46, 48, 50 that may feature identical or different widths. The exchangeable mold elements may, for example, feature a width of between ten centimeters and two meters enabling the width of the mold device 28, 32 to be adjusted to any desired working width of the slipform paver.

Figure 3:
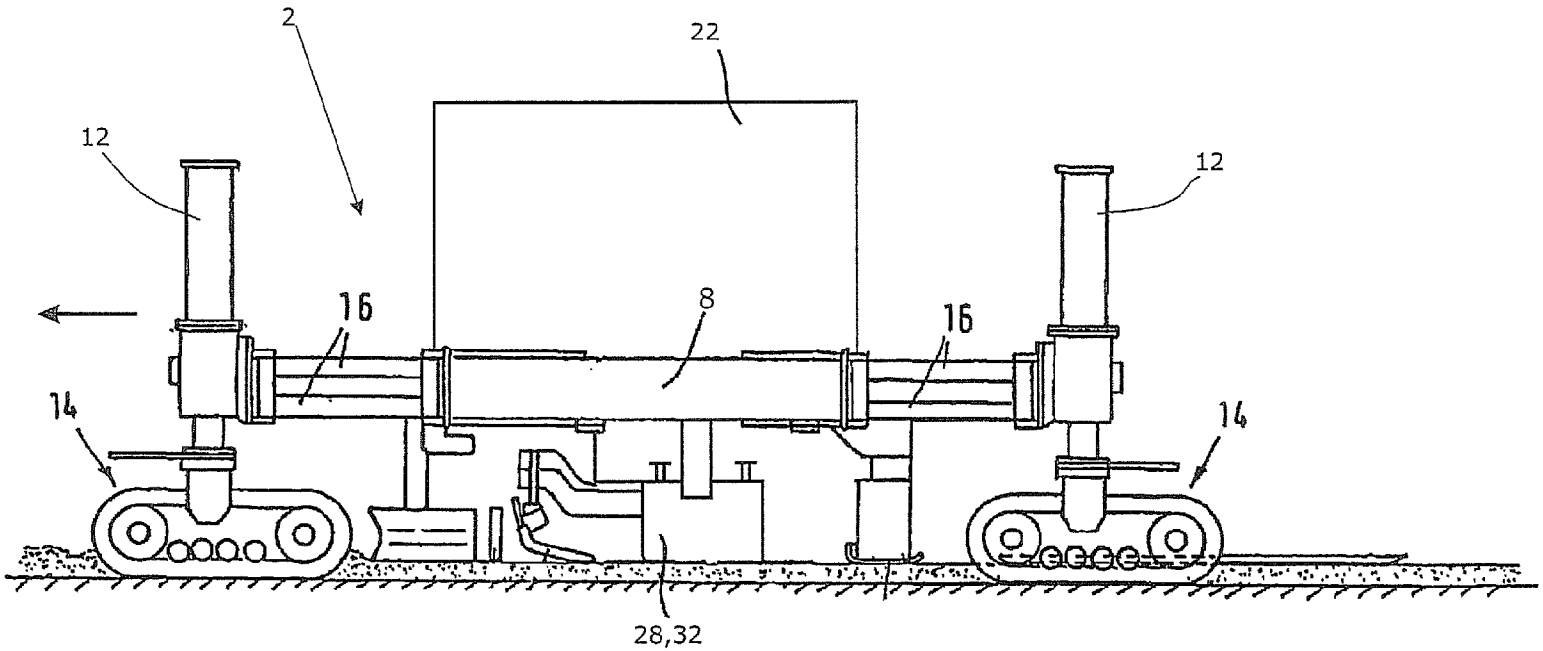
Figure 4:
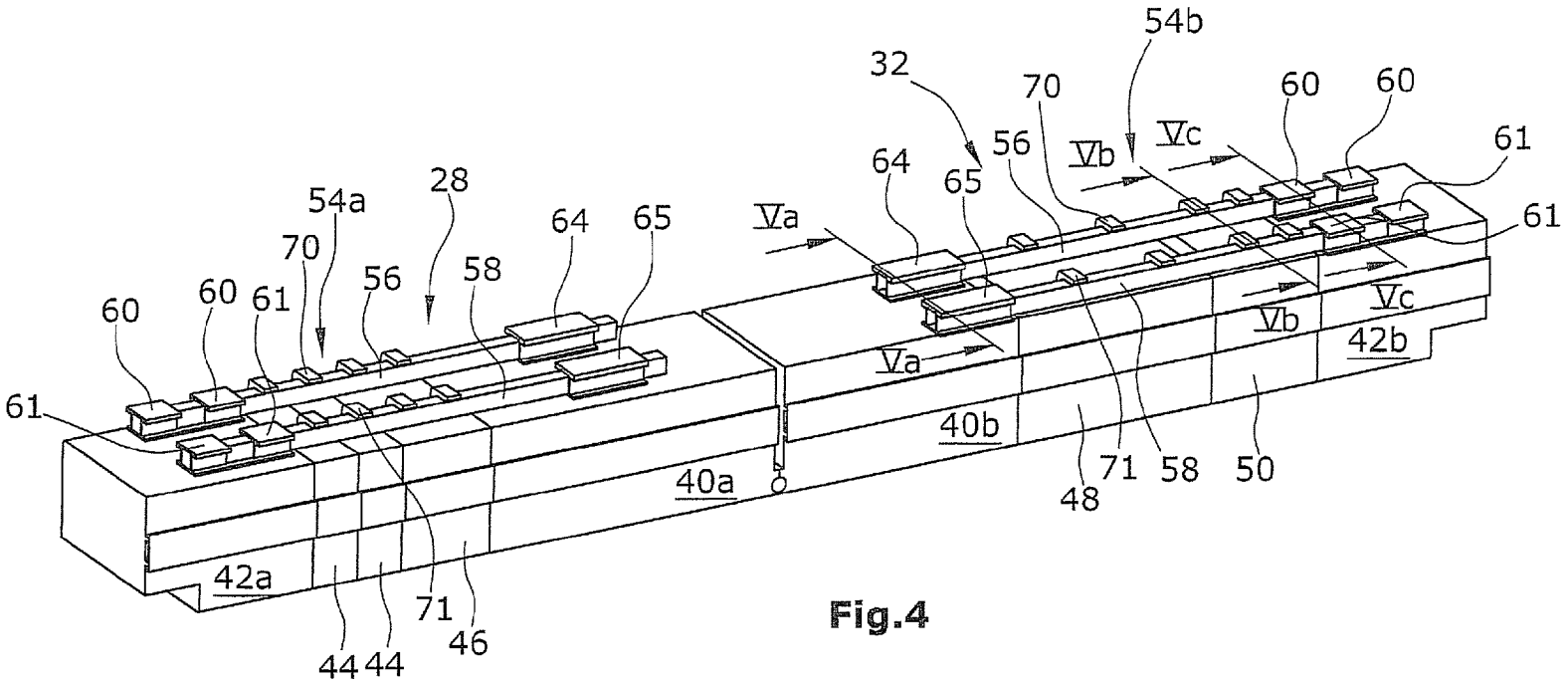

The outer permanent mold elements 42*a*, 42*b* are rigidly attached either to the cross member 18 arranged above them at that end of the same facing the longitudinal member 8, and/or to the longitudinal member 8 itself (FIG. 3) so that, when the ground-engaging units 14 are in a position pivoted about 90°, not only the working width of the machine frame 4 can be altered but the outer permanent mold elements 42*a*, 42*b* are additionally pulled outward. This results in a distance from the central permanent mold element 40*a*, 40*b* which enables the exchangeable mold elements 44, 46, 48, 50 to be inserted into the gap having formed.

To this effect, a self-supporting supporting device 54*a*, 54*b* is intended above the permanent mold elements 40*a*, 40*b*, 42*a*, 42*b* which connects all the mold elements 40 to 50.

All the permanent or permanent and exchangeable mold elements 40 to 50 are lockable with neighbouring mold elements.

After suspending, the exchangeable mold elements 44 to 50 are mounted on the respective supporting device 54*a*, 54*b* in a movable fashion so that the mold elements 40 to 50, so long as they are not yet locked with neighbouring mold elements, can be brought into a desired position without additional aids being required. In particular, no support means against the ground is required. This is of advantage as even ground is rarely available on construction sites for conversion of the slipform paver.

Figure 5A:
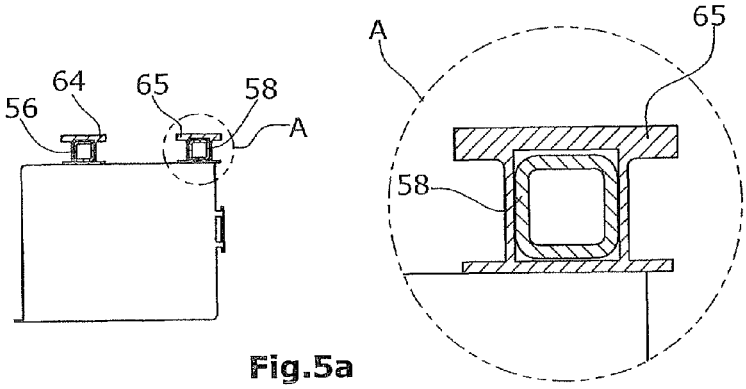
Figure 5B:
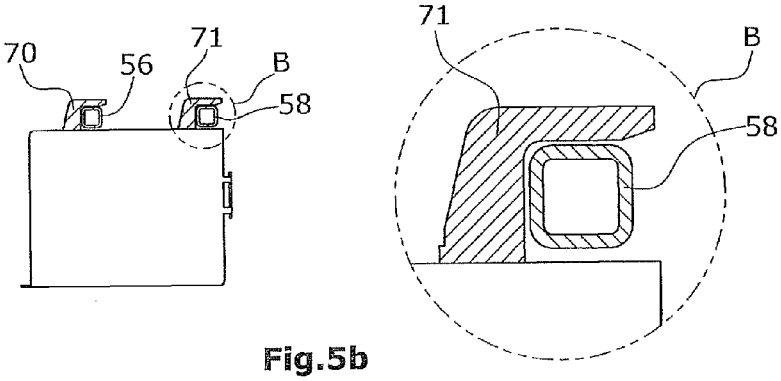
Figure 5C:
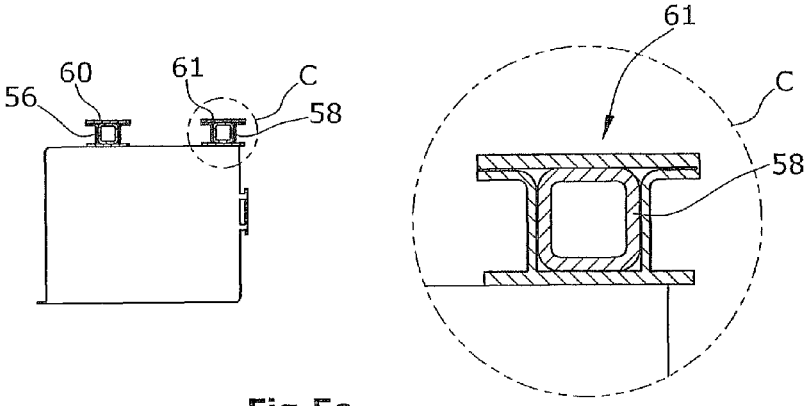

Each supporting device 54*a*, 54*b* comprises no less than two supporting beams 56, 58 extending parallel to one another which are fixed in place at the outer permanent mold element 42*a* or 42*b* respectively, as shown in FIG. 5*c*. It is preferred for the supporting beams 56, 58 to have a square or cuboid cross-sectional profile, each being fixed in place in two brackets 60, 61 arranged next to one another transverse to the working direction. The ends of the supporting beams 56, 58 pointing towards the center of the slipform paver are supported at the central permanent mold element 40*a*, 40*b* in sliding guides 64, 65 respectively. If all or some of the exchangeable mold elements 44 to 50 are removed and the outer permanent mold elements 42*a*, 42*b* moved inward by means of the ground-engaging units 14, the supporting beams 56, 58 can be moved inward through the sliding guides 64, 65.

In the process, the supporting beams 56, 58 of the one mold half 28 and the parallel supporting beams 56, 58 of the other mold half 32 are offset from one another in the working direction so that they cannot collide when the minimum working width is adjusted.

On their upper side, the exchangeable mold elements 44 to 50 comprise no less than two hooks 70, 71 offset in the working direction which can reach over the supporting beam 56 or 58 respectively so that the exchangeable mold element 44 to 50 can be placed onto the supporting beams 56, 58 in a transversely movable manner and positioned exactly in the working direction.

The hooks 70, 71 are curved in the working direction, may also be pointed in the opposite direction. A height adjustment device may be intended at the hooks 70, 71 so that fine adjustment of the height position of an exchangeable mold element 40 to 50 is possible.

The bisection of the mold device 28, 32 enables a camber to be adjusted preferably in the center of the working width by way of the central mold elements 40*a*, 40*b* being connected in an articulated fashion at their bottom edge and, at their upper edge, comprising an adjustment device not presented in detail for adjustment of the angle of the camber.

Figure 6:
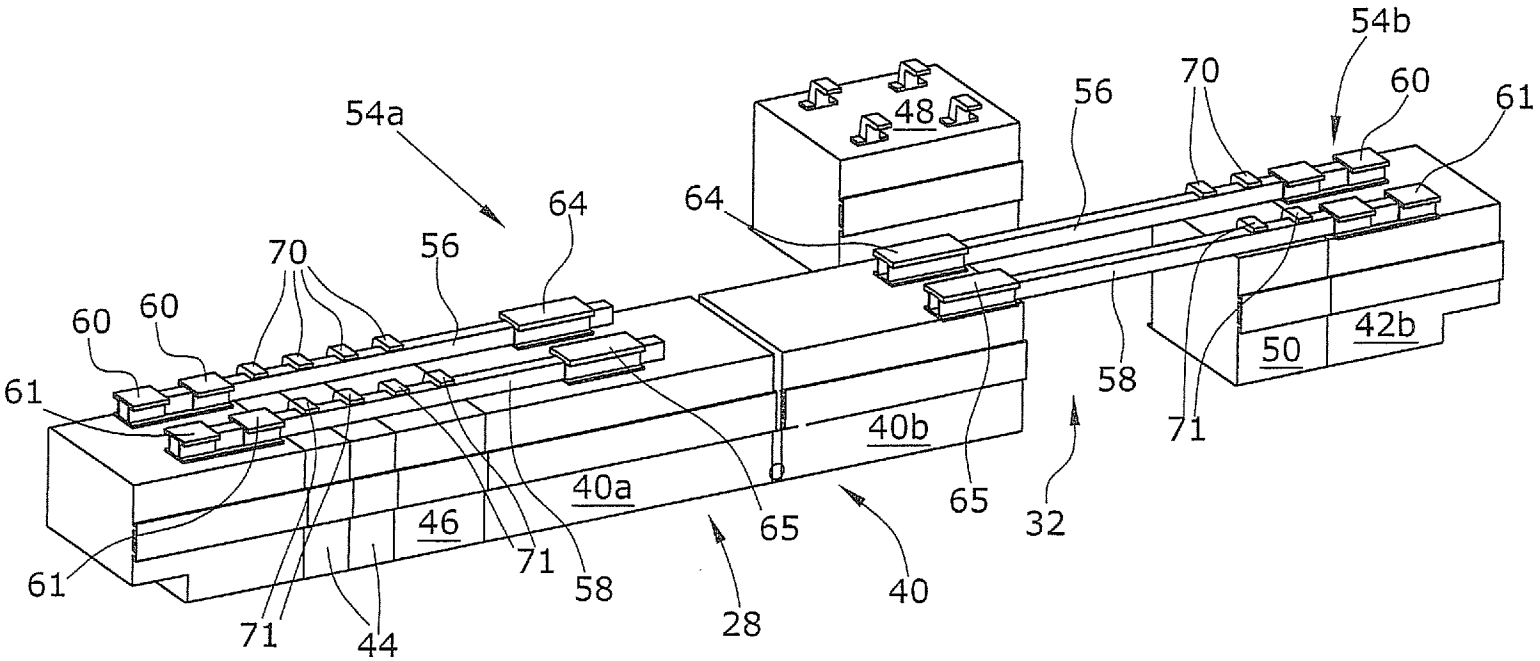

FIG. 6 shows the situation where a relatively wide exchangeable mold element 48 is to be inserted, for example, by means of a lift truck, into the gap between the permanent mold element 40*b* and the exchangeable mold element 50.

Figure 7:
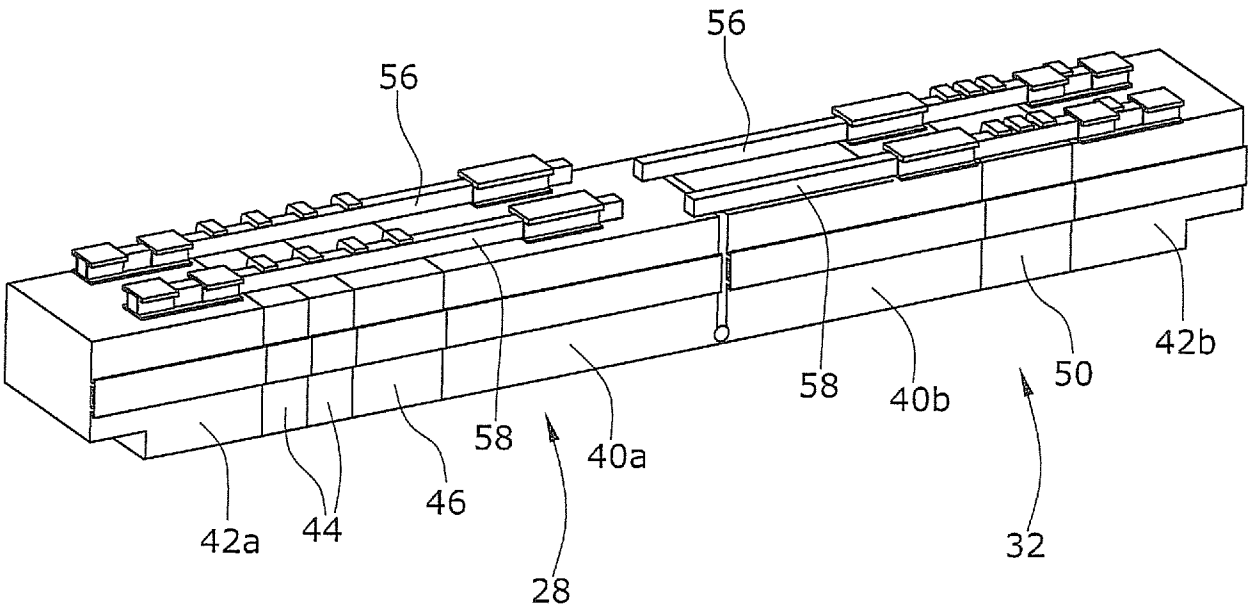

It can be inferred from FIG. 7 how the supporting beams 56, 58 reach over the central mold element 40*b* if only one exchangeable mold element 50 is inserted in the mold half 32.

What is claimed is:

1. A slipform paver apparatus, comprising:

a machine frame including first and second longitudinal members extending parallel to a working direction and at least one telescopable cross member extending transverse to the working direction for variable adjustment of a working width of the machine frame;

a plurality of ground-engaging units supporting the machine frame; and an adjustable width mold supported from the machine frame, the mold including:

at least one central mold element; and at least one outer mold element connected to one of the longitudinal members such that the at least one outer mold element is movable together with the connected longitudinal member relative to the central mold element during adjustment of the working width of the machine frame.

2. The apparatus of claim 1, wherein:

the at least one outer mold element comprises first and second outer mold elements connected to the first and second longitudinal members, respectively.

3. The apparatus of claim 1, wherein:

the mold further comprises a support arranged above the mold elements.

4. The apparatus of claim 3, wherein:

the mold is so arranged and constructed that when the machine frame is adjusted to a minimum working width the central and outer mold elements rest next to one another, and when the machine frame is adjusted to a wider working width an exchangeable mold element may be suspended from the support between the central and outer mold elements.

5. The apparatus of claim 3, wherein:

the support comprises at least one supporting beam fixed to the at least one outer mold element and guided for movement relative to the at least one central mold element.

6. The apparatus of claim 3, wherein:

the at least one central mold element includes first and second central mold elements and an articulated coupling between the first and second central mold elements;

the at least one outer mold element includes first and second outer mold elements on opposite sides of the central mold elements; and the support includes a first support beam extending between the first central mold element and the first outer mold element, and a second support beam extending between the second central mold element and the second outer mold element, such that an adjustable camber may be formed in a center of the working width.

7. The apparatus of claim 6, wherein:

the first and second support beams extend parallel to and offset from one another such that the support beams do not collide when the machine frame is adjusted to a minimum working width.

8. The apparatus of claim 1, wherein:

the ground-engaging units are steerable relative to the longitudinal members about an angle of at least 90°.

9. The apparatus of claim 1, further comprising:

a plurality of lifting columns, a lower end of each lifting column being connected to a respective one of the ground-engaging units; and a plurality of pivoting arms, each of the pivoting arms connecting a respective one of the lifting columns to a respective one of the longitudinal members.

10. The apparatus of claim 1, wherein:

the mold further comprises at least one supporting beam fixed to an upper side of the at least one outer mold element, and at least one sliding guide attached to an upper side of the at least one central mold element, the at least one supporting beam being slidably received in the at least one sliding guide.

11. The apparatus of claim 1, wherein:

the mold further comprises a plurality of exchangeable mold elements, the exchangeable mold elements being so arranged and constructed that different combinations of exchangeable mold elements are insertable between the central and outer mold elements, the different combinations being of different widths.

12. The apparatus of claim 11, wherein:

all of the mold elements are so arranged and constructed as to be lockable with neighboring mold elements.

13. The apparatus of claim 1, wherein:

the mold further comprises at least one exchangeable mold element receivable between the central and outer mold elements.

14. The apparatus of claim 13, wherein:

the mold further comprises a support arranged above the mold elements; and each exchangeable mold element is movably supported on the support.

15. The apparatus of claim 14, wherein:

each exchangeable mold element includes no less than two hooks open in the working direction so that the exchangeable mold element is received on the support from a rear relative to the working direction.

16. The apparatus of claim 14, wherein:

the support includes first and second parallel supports spaced apart in the working direction; and each exchangeable mold element includes first and second hooks offset from each other in the working direction, the hooks being configured to be received over the first and second parallel supports, respectively.

17. The apparatus of claim 14, wherein:

each exchangeable mold element includes first and second hooks spaced apart transversely to the working direction, the hooks being configured to be received over the support.

18. A slipform paver apparatus, comprising:

a machine frame including first and second longitudinal members extending parallel to a working direction and at least one telescopable cross member extending transverse to the working direction for variable adjustment of a working width of the machine frame;

a plurality of ground-engaging units supporting the machine frame; and an adjustable width mold supported from the machine frame, the mold including:

at least one central mold element;

at least one outer mold element laterally movable relative to the central mold element; and at least one exchangeable mold element receivable between the central and outer mold elements, the at least one exchangeable mold element being of integral design.

19. The apparatus of claim 18, wherein:

the at least one exchangeable mold element of integral design has a closed cross-sectional profile.

20. The apparatus of claim 18, wherein:

the mold further comprises a support arranged above the mold elements, the at least one exchangeable mold element being suspended from the support.

21. The apparatus of claim 20, wherein:

each exchangeable mold element includes no less than two hooks open in the working direction so that the exchangeable mold element is received on the support from a rear relative to the working direction.

22. The apparatus of claim 20, wherein:

the support includes first and second parallel supports spaced apart in the working direction; and each exchangeable mold element includes first and second hooks offset from each other in the working direction, the hooks being configured to be received over the first and second parallel supports, respectively.

23. The apparatus of claim 20, wherein:

each exchangeable mold element includes first and second hooks spaced apart transversely to the working direction, the hooks being configured to be received over the support.

24. The apparatus of claim 18, wherein:

the at least one exchangeable mold element is a single-part element.

* * * * *